US011434740B1

(12) United States Patent
Ngyuen et al.

(10) Patent No.: US 11,434,740 B1
(45) Date of Patent: Sep. 6, 2022

(54) METHODS OF FRACTURING AND RUPTURING ROCK FORMATIONS FOR ENHANCING HEAT EXCHANGE EFFICIENCY IN GEOTHERMAL WELLS

(71) Applicant: Halliburton Energy Services, Inc., Houston, TX (US)

(72) Inventors: Philip D. Ngyuen, Houston, TX (US); Ronald Glen Dusterhoft, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/500,787

(22) Filed: Oct. 13, 2021

(51) Int. Cl.
*E21B 43/267* (2006.01)
*E21B 43/263* (2006.01)
*E21B 36/00* (2006.01)

(52) U.S. Cl.
CPC ..... *E21B 43/263* (2013.01); *E21B 36/00* (2013.01); *E21B 43/267* (2013.01)

(58) Field of Classification Search
CPC ..... E21B 43/263; E21B 36/00; E21B 43/267
See application file for complete search history.

(56) References Cited

U.S. PATENT DOCUMENTS 5,346,015 A * 9/1994 Grundmann ..... E21B 43/263 166/308.1
7,073,581 B2 7/2006 Nguyen et al.
8,317,952 B2 11/2012 Katzakian et al.
8,430,166 B2 4/2013 Danko
8,617,327 B1 12/2013 Katzakian et al.
8,857,338 B2 10/2014 Sawka et al.
8,888,935 B2 11/2014 Grix et al.
9,182,207 B2 11/2015 McPherson et al.
9,328,034 B2 5/2016 McPherson et al.
9,541,309 B2 1/2017 Colwell
9,726,157 B2 8/2017 Sweatman et al.
(Continued)

FOREIGN PATENT DOCUMENTS

EP 3828380 A1 6/2021
WO WO-2019027470 A1 * 2/2019 ..... C09K 8/64
WO 2020037062 A1 2/2020

*Primary Examiner* — Silvana C Runyan
(74) *Attorney, Agent, or Firm* — Conley Rose, P.C.; Rodney B. Carroll

(57) ABSTRACT

The disclosure provides for a method of enhancing heat transfer between an injection fluid and a subterranean formation. The method comprises of introducing a fracturing fluid into a first wellbore and a second wellbore comprising a plurality of electro-conductive proppants and electrically controlled propellant, wherein the fracturing fluid is introduced at or above a pressure sufficient to create or enhance one or more primary fractures in the subterranean formation. The method further comprises of applying an electrical current, wherein the plurality of electro-conductive proppants is operable to receive the electrical current and igniting the electrically controlled propellant through application of the electrical current from the plurality of electro-conductive proppants to rubblize the subterranean formation. The method further comprises introducing an injection fluid into the first wellbore, wherein the injection fluid is operable to absorb heat from available surface area from the rubblized subterranean formation.

20 Claims, 5 Drawing Sheets

(56) References Cited

U.S. PATENT DOCUMENTS

| | | | | |
|---|---|---|---|---|
| 10,301,536 | B2 | 5/2019 | Cannan et al. | |
| 10,551,091 | B2 | 2/2020 | Krüger | |
| 10,578,763 | B2 * | 3/2020 | Gabelmann | E21B 43/267 |
| 10,927,604 | B2 | 2/2021 | Danko | |
| 10,975,295 | B2 | 4/2021 | Cannan et al. | |
| 2009/0320475 | A1 | 12/2009 | Parrella | |
| 2011/0061382 | A1 | 3/2011 | Stern | |
| 2011/0247816 | A1 * | 10/2011 | Carter, Jr. | E21B 43/305 166/298 |
| 2012/0198844 | A1 | 8/2012 | Kaminsky | |
| 2013/0112402 | A1 | 5/2013 | Harris et al. | |
| 2017/0211849 | A1 | 7/2017 | Muir et al. | |
| 2019/0330520 | A1 * | 10/2019 | Cannan | E21B 43/26 |
| 2020/0011151 | A1 | 1/2020 | Toews et al. | |
| 2020/0011573 | A1 | 1/2020 | Graham et al. | |
| 2020/0190937 | A1 | 6/2020 | Nevison et al. | |
| 2020/0191444 | A1 | 6/2020 | Nevison et al. | |
| 2020/0217181 | A1 | 7/2020 | Norbeck et al. | |

* cited by examiner

METHODS OF FRACTURING AND RUPTURING ROCK FORMATIONS FOR ENHANCING HEAT EXCHANGE EFFICIENCY IN GEOTHERMAL WELLS

TECHNICAL FIELD OF THE INVENTION

The present disclosure relates generally to well operations and, more particularly, to systems and methods for fracturing formations to enhance heat exchange efficiency in geothermal wells.

BACKGROUND

Wells in hydrocarbon-bearing subterranean formations are often stimulated to produce hydrocarbons using hydraulic fracturing treatments. In hydraulic fracturing treatments, a viscous fracturing fluid, which also may function as a carrier fluid, is pumped into a producing zone at a sufficiently high rate and/or pressure such that one or more fractures are formed in the zone. These fractures provide conductive channels through which fluids in the formation such as oil and gas may flow to a wellbore for production. In order to maintain sufficient conductivity through the fracture, it is often desirable that the formation surfaces within the fracture or "fracture faces" be able to resist erosion and/or migration to prevent the fracture from narrowing or fully closing. Proppant particulates may be suspended in a portion of the fracturing fluid and deposited in the fractures when the fracturing fluid is converted to a thin fluid to be returned to the surface. These proppant particulates serve to prevent the fractures from fully closing so that conductive channels are formed through which produced hydrocarbons can flow.

As the true vertical depth of a wellbore increases in the subterranean formation, the bottomhole temperature of the wellbore also increases. The time period required for a low-temperature fluid injected into a wellbore to obtain a desirable temperature and be able to transform into a heat-treated fluid (i.e., supercritical fluid) depends on the fluid injection rate and the contact surface area of rock formation available for interacting with the fluid. Fluids tend to find the path of least resistance; therefore the faster the fluid flows through an open or propped fracture, the lesser the amount of heat a fluid can absorb to allow it to efficiently transform into a heat-treated fluid as a result of the lower residence or contact time of the fluid with the rock formation surface area. Open or propped fractures of conventional hydraulic fracturing treatments may act as direct channels and may not provide sufficient surface areas to allow sufficient effective heat exchange between high temperature rock formations and low-temperature injected fluid. Fracturing tight formations requires high injection rates and large volumes of fracturing fluid to effectively produce complex fracture networks. In many cases, however, these fractures may lack the desired complexity to act as a truly effective heat exchanger. To produce a complex fracture network, conventional propellants can be used. The conventional propellants are reactive, which is not desirable, especially with safety requirements for oilfield applications. Once the conventional propellants are ignited or detonated, their combustion or activation cannot be stopped.

BRIEF DESCRIPTION OF THE DRAWINGS

These drawings illustrate certain aspects of some of the embodiments of the present disclosure and should not be used to limit or define the claims.

Figure 1A:
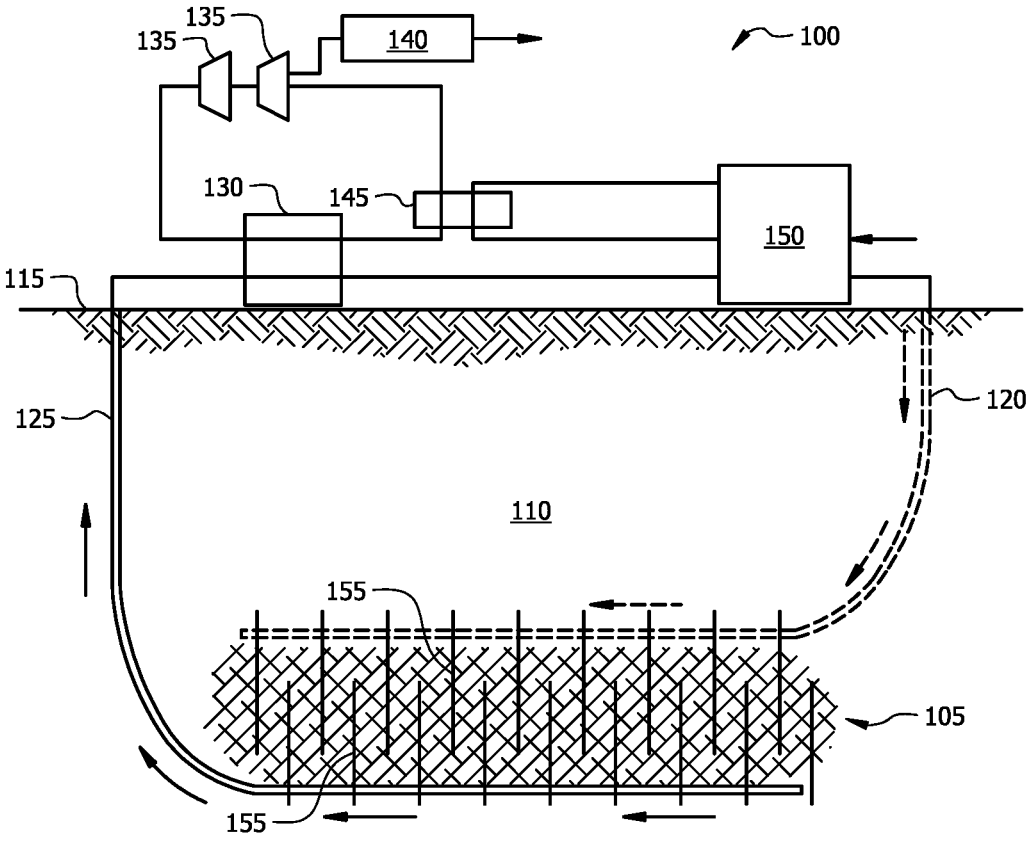
FIGS. 1A and 1B are diagrams illustrating an example energy recovery system with an example fracture network, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "la" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure. Embodiments described below with respect to one implementation are not intended to be limiting.

The terms "couple" or "couples," as used herein, are intended to mean either an indirect or direct connection. Thus, if a first device couples to a second device, that connection may be through a direct connection, or through an indirect electrical connection or a shaft coupling via other devices and connections.

The present disclosure provides for systems and methods using electrically controlled propellant and electro-conductive proppant to generate complex fracture networks in subterranean formations. In accordance with the methods of the present disclosure, a first wellbore is drilled to penetrate at least a portion of a subterranean formation of interest, and optionally may be cased and/or otherwise completed. Then, one or more secondary wellbores are drilled in the subterranean formation in a region near the first wellbore. An electrically controlled propellant is introduced into the first wellbore and/or secondary wellbores. The electrically controlled propellant is then ignited, via the electro-conductive proppant, to at least partially rupture a portion of the subterranean formation, thereby forming a complex fracture network comprised of secondary or tertiary fractures (e.g., cracks or fissures) therein. In certain methods of the present disclosure, these secondary and tertiary fractures can be connected to a primary fracture, which may be formed by isolating and perforating an area of interest in the first wellbore and/or second wellbores, and introduction of a high viscosity fluid at or above a pressure sufficient to create or enhance at least one primary fracture within the subterranean formation. Connection of the primary fracture to the complex fracture network may, among other benefits, enhance production of hydrocarbons from the subterranean formation.

Among the many potential advantages to the methods and compositions of the present disclosure, only some of which are alluded to herein, the methods, compositions, and systems of the present disclosure may help optimize fracturing treatments and other operations in a number of ways. For example, in some embodiments, the methods of the present disclosure may reduce or eliminate the use of large volumes of fluids (e.g., water) and/or proppants used in conventional fracturing treatments, and/or reduce the amount of pumping horsepower required to create complex fracturing geometries in subterranean shale formations through the use of a multi-mode failure of the subterranean formations. Reducing the amount of water used in fracturing operations may, among other benefits, reduce flowback volume and/or costs of disposing flowback water. Reducing or eliminating the amount of fracturing sand or other proppants used in fracturing operations may, among other benefits, simplify the composition of fracturing fluids that no longer need to suspend proppant particulates, reduce proppant settling issues, may decrease the abrasion to well site equipment from pumping proppant slurries into the formation, and/or minimize the maintenance cost of pumping equipment. In certain embodiments, the ignition of electrically controlled propellants used in the methods and systems of the present disclosure may be more effectively controlled as compared to other types of explosives or downhole energy sources. For example, these electrically controlled propellants may be less likely to spontaneously ignite, particularly at elevated pressure and/or temperature conditions experienced downhole. For these and other reasons, the methods and systems of the present disclosure may present fewer or less significant safety risks in their manufacturing, transportation, handling, and use than other methods and systems using other energy sources. Moreover, in some embodiments, it may be possible to cease the ignition of an electrically controlled propellant (e.g., by discontinuing the flow of electrical current therethrough), and then re-ignite the remaining portion of material at a subsequent time by re-applying electrical current to that same area. Consequently, in some embodiments, the methods and systems of the present disclosure may provide ways of fracturing or otherwise stimulating subterranean formations that can be used or actuated repeatedly without repeated interventions in the same well or placement of additional treatment fluids therein.

An example of a fracture network created and/or enhanced according to certain methods of the present disclosure is illustrated in FIGS. 1A-4D. FIGS. 1A and 1B illustrate an example energy recovery system 100 used with an example fracture network 105 within a subterranean formation 110. As illustrated, the energy recovery system 100 may be disposed about any suitable location along a surface 115 wherein a first wellbore 120 and a second wellbore 125 may be drilled through. The energy recovery system 100 may be a closed-loop system operable to utilize heat-treated fluid, wherein the heat may be obtained from the subterranean formation 110, to produce electrical power for further operations. With reference to FIG. 1A, the energy recovery system 100 may comprise a first heat exchanger 130, one or more turbines 135, a generator 140, a second heat exchanger 145, and a cooling tower 150.

In one or more embodiments, the first heat exchanger 130 and the second heat exchanger 145 may be parallel-flow heat exchangers, wherein two fluids enter an exchanger at a same end and travel the exchanger parallel relative to each other. In other embodiments, the first heat exchanger 130 and the second heat exchanger 145 may be counter-flow heat exchangers wherein the two fluids enter an exchanger at opposite ends. In other embodiments, the first heat exchanger 130 and the second heat exchanger 145 may be cross-flow heat exchangers, plate heat exchangers, etc. The first heat exchanger 130 and the second heat exchanger 145 may be comprised of multiple layers of different materials, such as copper flow tubes with aluminum fins or plates. Both the first heat exchanger 130 and the second heat exchanger 145 may be operable to transfer heat from one fluid to another fluid. For example, a heat-treated fluid may be produced from the second wellbore 125 and be introduced into the first heat exchanger 130. Additionally, a second fluid, contained within the closed-loop system of the energy recovery system 100, may be introduced into the first heat exchanger 130, wherein the temperature of the second fluid is lower than the temperature of the heat-treated fluid. In one or more embodiments, the first heat exchanger 130 may be configured to transfer heat from the heat-treated fluid to the second fluid, thereby increasing the temperature of the second fluid.

The second fluid may then flow from the first heat exchanger 130 to the one or more turbines 135. The one or more turbines 135 may be operable to rotate, based on the introduction of the second fluid, and produce work. Without limitations, any suitable turbine may be used as the one or more turbines 135. The one or more turbines 135 may be coupled to the generator 140. The work produced by the one or more turbines 135 may be used by the generator 140 to produce electrical power. The generator 140 may be operable to convert mechanical energy into electrical power. In one or more embodiments, the amount of work and subsequent electrical power produced may be related to the temperature of the second fluid. As the temperature of the second fluid increases, the amount of work and subsequent electrical power produced may increase. After flowing through the one or more turbines 135, the second fluid may be discharged and introduced into the second heat exchanger 145. The second heat exchanger 145 may be configured to transfer heat from the second fluid to a third fluid contained within a piping configuration. The third fluid may be used in conjunction with the cooling tower 150, wherein the cooling tower 150 may be operable to reduce the temperature of the third fluid. The second fluid may be discharged from the second heat exchanger 145 at a lower temperature than when the second fluid was introduced into the second heat exchanger 145. The second fluid may then flow to the first heat exchanger 130 and repeat the cycle.

With reference back to the first heat exchanger 130, the heat-treated fluid may be discharged from the first heat exchanger 130 at a lower temperature relative to when the heat-treated fluid was introduced into the first heat exchanger 130. The heat-treated fluid may then flow to the first wellbore 120 and may be injected into the first wellbore 120 in order to absorb heat from the subterranean formation 110 to be used by the energy recovery system 100.

Figure 1B:
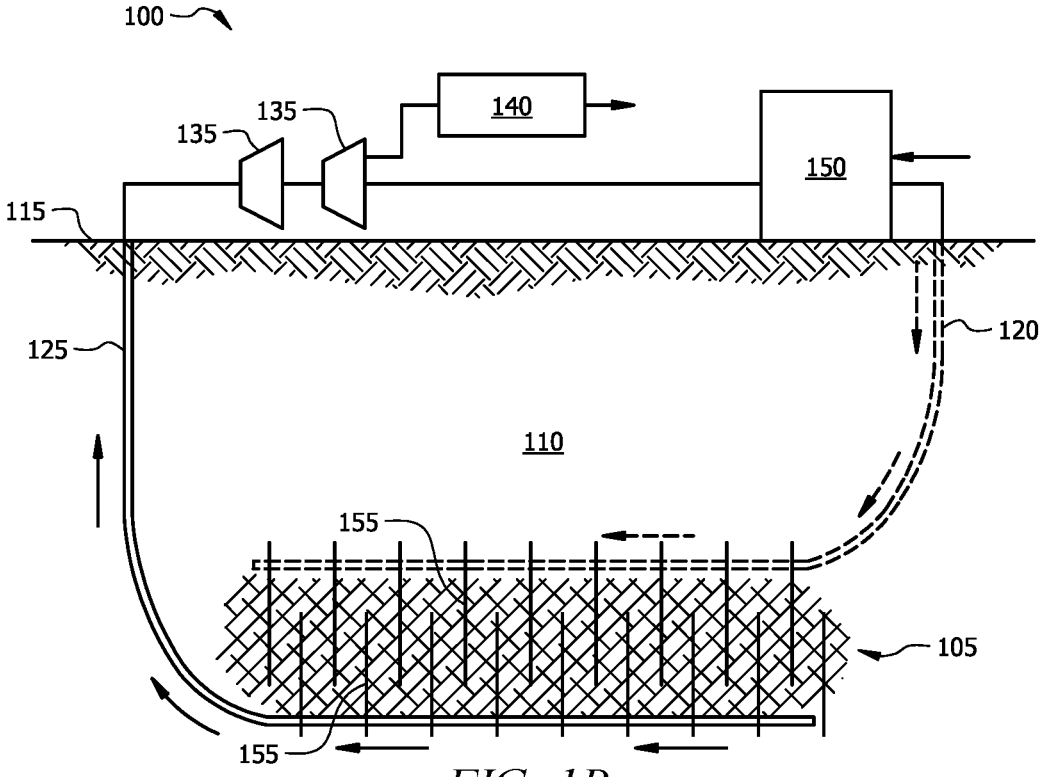

With reference to FIG. 1B, the energy recovery system 100 may comprise the one or more turbines 135, the generator 140, and the cooling tower 150. In this embodiment, the heat-treated fluid may be configured to flow from the second wellbore 125 to the one or more turbines 135. The heat-treated fluid may be operable to actuate the one or more turbines 135 to rotate, thereby generating electrical power via the generator 140 coupled to the one or more turbines 135. The heat-treated fluid may then flow to the cooling tower 150, wherein the cooling tower 150 may be operable to reduce the temperature of the heat-treated fluid. In one or more embodiments, the cooling tower 150 may be replaced with any other suitable heat exchanger. The heat-treated fluid may then be injected into the first wellbore 120 in order to absorb heat from the subterranean formation 110 to be used by the energy recovery system 100.

As illustrated in both FIGS. 1A-1B, the first wellbore 120 is shown penetrating a portion of the subterranean formation 110. It is to be understood that "subterranean formation" encompasses both areas below exposed earth and areas below earth covered by water such as ocean or fresh water. In one or more embodiments, the first wellbore 120 may have been at least partially cased and/or cemented during or prior to the remaining portions of the operation. A portion of the first wellbore 120 may be oriented horizontally, although a person of skill in the art with the benefit of this disclosure will recognize that the methods of the present disclosure could be similarly applied to sections of a well bore that are vertical or deviated from vertical to a lesser degree.

At least one second wellbore 125 may be drilled near the first wellbore 120. The second wellbore 125 is drilled, as illustrated, at a depth further from the surface 115 than the first wellbore 120, although a person of skill in the art with the benefit of this disclosure will recognize that the methods of the present disclosure could similarly be applied to second wellbores 125 being drilled at a shallower depth than the first wellbore 120, or around the same depth as the first wellbore 120. In one or more embodiments, the second wellbore 125 is drilled substantially parallel to the first wellbore 120. The second wellbore 125 is oriented horizontally, although a person of skill in the art with the benefit of this disclosure will recognize that the methods of the present disclosure could be similarly applied to sections of a well bore that are vertical or deviated from vertical to a lesser degree, in which the second wellbore 125 would also be vertical or deviated from vertical to a lesser degree. In one or more embodiments, the second wellbore 125 may have been at least partially cased and/or cemented during or prior to the remaining portions of the operation.

In one or more embodiments, a treatment fluid (e.g., a fracturing fluid) may be introduced into the first wellbore 120 and/or the second wellbore 125 to create one or more primary fractures 155 extending from either the first wellbore 120 or the second wellbore 125. Each of the one or more primary fractures 155 may have been created by introducing the treatment fluid into the first wellbore 120 and/or the second wellbore 125 at or above a pressure sufficient to create or enlarge the one or more primary fractures 155. Perforations can be formed in a casing to allow fracturing fluids and/or other materials to flow into the subterranean formation 110. Perforations can be formed using any known means, including shape charges, a perforating gun, and hydro jetting and/or other tools. The portion of the first wellbore 120 and/or the second wellbore 125 proximate to the portion of the subterranean formation 110 to be fractured also may be isolated using any known method of zonal isolation, including but not limited to packers, plugs, sand, gels, valves, and the like. In one or more embodiments, after isolating and perforating an area of interest, the fracturing fluid (e.g., a high viscosity fluid) is introduced at or above a pressure sufficient to create or enhance at least one primary fracture 155 in the subterranean formation 110. In one or more embodiments, the high viscosity fluid has a fluid viscosity of about 100 cP or higher, up to about 5,000 cP.

In one or more embodiments, a first low viscosity fluid is introduced into the first wellbore 120 and/or the second wellbore 125 after creation of the one or more primary fractures 155 at or above a pressure sufficient to create or enhance at least one fracture in the subterranean formation 110. In one or more embodiments, the first low viscosity fluid has a fluid viscosity of about 25 cP or lower. The first low viscosity fluid may carry microproppant. Introduction of the first low viscosity fluid with microproppant may extend the one or more primary fractures 155 and/or place the microproppant particles in induced microfractures or fissures to keep them open. In one or more embodiments, the fracturing fluid and/or the first low viscosity fluid further comprises one or more chelating agents, acids, or delayed, in-situ acid generators. These agents may produce one or more acids in the subterranean formation 110, which may dissolve or otherwise interact with rock in the subterranean formation 110 to increase its porosity and/or conductivity, which may enhance the connectivity between the first wellbore 120 and second wellbore 125.

In one or more embodiments, following the introduction of the first low viscosity fluid, a second low viscosity fluid may be introduced into the first wellbore 120 and/or the second wellbore 125 at or above a pressure sufficient to create or enhance at least one fracture in the subterranean formation 110. The second low viscosity fluid may carry proppant. Proppant materials that may be suitable for use include, but are not limited to, natural sands; resin-coated sands, curable resin-coated proppants; gravels; synthetic organic particles, nylon pellets, high density plastics, composite polymers, polytetrafluoroethylenes, rubbers, resins; ceramics, aluminosilicates; glass; sintered bauxite; quartz; aluminum pellets, metal shots; ground or crushed shells of nuts, walnuts, pecans, almonds, ivory nuts, brazil nuts, or combinations thereof. In one or more embodiments, the second low viscosity fluid can comprise a gradual increase in mesh sizes (e.g., 200-mesh to 100-mesh to 40/70-mesh) and concentrations of proppant (e.g., 0.5 lbm/gal to 1 lbm/gal to 2 lbm/gal) to place the proppant in the one or more primary fractures 155 and large fracture branches.

In one or more embodiments, a low viscosity fluid may be substantially "waterless" in that the fluid does not comprise a significant amount of water (e.g., less than 5%, 1%, or 0.1% by volume), or alternatively, any amount of water. Examples of a substantially "waterless" fluid according to the present disclosure include, but are not limited to, liquid methane, liquefied natural gas, liquid gas hydrocarbon, liquid $CO_2$, liquid $N_2$, or any combination thereof. In one or more embodiments, a substantially "waterless" low viscosity fluid is preferred.

In one or more embodiments, a fracturing fluid may comprise a waterless fluid. Examples of waterless fluids that can be used as fracturing fluids according to the present disclosure include, but are not limited to, a foamed liquid gas, such as a foamed natural gas liquid, a foamed liquid gas hydrocarbon, a foamed liquid CO2, a foamed liquid N2, or any combination thereof. In one or more embodiments, a substantially "waterless" fracturing fluid is preferred.

In one or more embodiments, a large volume of the high viscosity fluid may be introduced into the first wellbore 120 and/or the second wellbore 125, followed by intermittent or alternating introductions of a small volume of the first low viscosity fluid containing microproppant. In this embodiment, introduction of the high viscosity fluid may extend the length and height of the at least one primary fracture 155, while introduction of the low viscosity fluid may induce the development of secondary fractures along the primary fracture 155 and allow for placement of microproppant in microfractures.

In one or more embodiments, multiple primary fractures 155 are created by repeating the isolating and fracturing sequence described above for multiple intervals along the first wellbore 120 and/or the second wellbore 125. In one or more embodiments, the one or more intervals start from the distal or far end of the first wellbore 120 and/or the second wellbore 125, thereby providing effective production of hydrocarbons from the subterranean formation 110.

The treatment fluids used in the methods and systems of the present disclosure may comprise any base fluid known in the art, including aqueous fluids, non-aqueous fluids, gases, or any combination thereof. Aqueous fluids that may be suitable for use in the methods and systems of the present disclosure may comprise water from any source, provided that it does not contain compounds that adversely affect other components of the treatment fluid. Such aqueous fluids may comprise fresh water, salt water (e.g., water containing one or more salts dissolved therein), brine (e.g., saturated salt water), seawater, or any combination thereof. In certain embodiments, the density of the aqueous fluid can be adjusted, among other purposes, to provide additional particulate transport and suspension in the compositions of the present disclosure. In certain embodiments, the pH of the aqueous fluid may be adjusted (e.g., by a buffer or other pH adjusting agent) to a specific level, which may depend on, among other factors, the types of gelling agents, acids, and other additives included in the fluid. One of ordinary skill in the art, with the benefit of this disclosure, will recognize when such density and/or pH adjustments are appropriate. Examples of non-aqueous fluids that may be suitable for use in the methods and systems of the present disclosure include, but are not limited to, oils, hydrocarbons, organic liquids, and the like. In certain embodiments, the treatment fluids may comprise a mixture of one or more fluids and/or gases, including but not limited to emulsions, foams, and the like. The fluids may be modified with additives to increase efficiency and reliability. Suitable additives include, anti-scaling agents, anti-corrosion agents, friction reducers, and anti-freezing chemicals, refrigerants, biocides, hydrocarbons, alcohols, organic fluids and combinations thereof.

The treatment fluids used in the methods and systems of the present disclosure may comprise a plurality of proppants. The proppants used in the methods and systems of the present disclosure may comprise any particulate capable of being deposited in one or more of the fractures in the subterranean formation 110 (whether created, enhanced, and/or pre-existing). In embodiments, larger particles may function to divert and smaller particles may stay with the fluid. Further, the proppant particulates may be bi-modal with one of the dominant concentrations being microproppant. Examples of proppant particulates that may be suitable for use include, but are not limited to: bubbles or microspheres, such as made from glass, ceramic, polymer, sand, and/or another material. Other examples of proppant particulates may include particles of any one or more of: calcium carbonate (CaCO3); barium sulfate (BaSO4); organic polymers; cement; boric oxide; slag; sand; bauxite; ceramic materials; glass materials; polymer materials; polytetrafluoroethylene materials; nut shell pieces; cured resinous particulates comprising nut shell pieces; seed shell pieces; cured resinous particulates comprising seed shell pieces; fruit pit pieces; cured resinous particulates comprising fruit pit pieces; wood; composite particulates; and combinations thereof. Suitable composite particulates may comprise a binder and a filler material wherein suitable filler materials may include any one or more of: silica; alumina; fumed carbon; carbon black; graphite; mica; titanium dioxide; meta-silicate; calcium silicate; kaolin; talc; zirconia; boron; fly ash; hollow glass microspheres; solid glass; and combinations thereof. In certain embodiments, the proppant particulates may be at least partially coated with one or more substances such as tackifying agents, silyl-modified polyamide compounds, resins, crosslinkable aqueous polymer compositions, polymerizable organic monomer compositions, consolidating agents, binders, or the like.

In one or more embodiments, the treatment fluids used in the methods and systems of the present disclosure may comprise a plurality of electro-conductive proppants. The electro-conductive proppants described herein may be composed of solid particulate material that is at least partially coated with an electroconductive resin. This does not imply a 100% coating, and in some instances, greater than about 25% to 100% of the surface of the solid particulate material is coated with the electroconductive resin. In one specific embodiment, the coating amount (and thickness) is selected to achieve a conductivity of at least about 1 milliampere (mA). In specific embodiments, the coating amount (and thickness) is selected to achieve a conductivity of at least about 1 mA to about 100 mA, encompassing any value and subset therebetween. In another specific embodiment, the electroconductive resin is coated onto the surface of the solid particulate material in an amount in the range of from about 0.1% to about 6% by weight of the solid particulate material, encompassing any value and subset therebetween.

The solid material used in forming the electro-conductive proppants of the present disclosure may be any solid material, which itself may or may not be capable of withstanding fracture closure pressures (i.e., acting as proppant), as described above. Generally, the electro-conductive proppants of any size and shape for use in the embodiments described herein, and further described below, may be included in any treatment fluid in the range of from about 2% to about 95% by volume of the base fluid of the treatment fluid in which they are included, encompassing any value and subset therebetween.

The electroconductive resin for forming the electro-conductive proppants of the present disclosure may be a curable resin mixed with a conductive material. Examples of suitable curable resins may include, but are not limited to, two component epoxy-based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and any combination thereof. Suitable conductive materials may include, but are not limited to, powders that comprise conductive particulates, such as graphite, copper, iron, zinc, brass, tin, conductive plastics, conductive graphite materials, and any combination thereof. In one specific embodiment, the electroconductive resin may comprise an epoxy resin containing fine graphite powder. In another specific embodiment, the electroconductive resin may comprise a furan resin containing fine particulate copper.

In one or more embodiments, the preparation of an electro-conductive proppant may comprise coating a film of a resin or a tackifying agent on the surfaces of the proppant grains and mixing (or spray coating) the coated proppant with fine particulates of an electrically conductive material, wherein the electrically conductive material is selected from the group consisting of aluminum, iron, copper, nickel, cobalt, and zinc and any alloy or mixture thereof. Other electrically conductive material is selected from the group consisting of pyrolytic carbon, carbon black, graphite, coke breeze, petroleum coke, carbon fiber, and carbon nanotubes and combination thereof. The electrically conductive material is in the form of metal clusters, metal flake, metal shot, metal powder, metalloids, metal nanoparticles, quantum dots, or carbon nanotubes.

It is to be understood that "proppants" herein encompasses "electro-conductive proppants". The proppant particulates may be of any size and/or shape suitable for the particular application in which they are used. In one or more embodiments, the proppant particulates may have a particle size less than 100 microns. In certain embodiments, the proppant particulates used may have a particle size in the range of from about 2 to about 400 mesh, U.S. Sieve Series. In certain embodiments, the proppant may comprise graded sand having a particle size in the range of from about 10 to about 70 mesh, U.S. Sieve Series. Preferred sand particle size distribution ranges may be one or more of 10-20 mesh, 20-40 mesh, 30-50 mesh, 40-60 mesh or 50-70 mesh, depending on, for example, the fracture geometries of the subterranean formation 110, the location in the subterranean formation 110 where the proppant particulates are intended to be placed, and other factors. In certain embodiments, a combination of proppant particulates having different particle sizes, particle size distributions, and/or average particle sizes may be used. In certain embodiments, proppant particulates of different particle sizes, particle size distributions, and/or average particle sizes may be used in different stages of proppant-carrying fluid in a single fracturing operation. For example, earlier stages of proppant-carrying fluid may include smaller proppant particulates that can enter the narrower tip regions of fractures in the subterranean formation 110, while larger proppant particulates may be used in subsequent stages that may be deposited in the fracture without approaching the tip regions.

Proppants may be included in the proppant-carrying treatment fluid in any suitable concentration. In certain embodiments, the concentration of particulates in the proppant-carrying treatment fluid may range from about 0.1 to about 8 lb/gal. In other embodiments, it may range from about 0.5 to about 5.0 lb/gal, and in some embodiments, from about 1.5 to about 2.5 lb/gal. In one or more embodiments, the concentration of particulates in the proppant-carrying fluid may have an approximate lower range of any one of: 0.5, 0.6, 0.7, 0.8, 0.9, 1.0, 1.1, 1.2, 1.3, 1.4, 1.5, 1.6, 1.7, 1.8, 1.9, and 2.0 lb/gal; and an upper range of approximately any one of: 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5 lb/gal, and so on up to 8.0 lb/gal in increments of 0.1 lb/gal. Thus, the concentration range of particulates of some example embodiments may be from about 0.5 lb/gal to about 1.0 lb/gal, or from about 1.0 lb/gal to about 4.4 lb/gal, or from about 2.0 lb/gal to about 2.5 lb/gal, and so on, in any combination of any one of the upper and any one of the lower ranges recited above (including any 0.1 lb/gal increment between 4.5 and 8.0 lb/gal). A person of skill in the art with the benefit of this disclosure will recognize the appropriate amount of proppants to use in an application of the present disclosure based on, among other things, the type of formation, the particle size of the proppant, the parameters of the fracturing operation, fracture geometries, and the like. In certain embodiments, the proppants may be categorized as microproppants or may generally be inclusive of microproppants.

In certain embodiments, the treatment fluids used in the methods of the present disclosure may include a plurality of microproppant particles, for example, to be placed in microfractures within the subterranean formation 110. As used herein, the term "plurality" refers in a non-limiting manner to any integer equal or greater than 1. The use of the phrase "plurality of microproppant particles" is not intended to limit the composition of the plurality of microproppant particles or the type, shape, or size, etc. of the microproppant particles within the plurality. For instance, in certain embodiments, the composition of the plurality of microproppant particles may be substantially uniform such that each microproppant particle within the plurality is of substantially similar type, shape, and/or size, etc. In other embodiments, the composition of the plurality of microproppant particles may be varied such that the plurality includes at least one microproppant particle of a particular type, shape, and/or size, etc. and at least one other microproppant particle of a different type, shape, and/or size, etc.

Examples of materials that may be suitable for use as microproppant particles in certain embodiments of the present disclosure include, but are not limited to, fly ash, silica, alumina, fumed carbon (e.g., pyrogenic carbon), carbon black, graphite, mica, titanium dioxide, metal-silicate, silicate, kaolin, talc, zirconia, boron, hollow microspheres (e.g., spherical shell-type materials having an interior cavity), glass, calcined clays (e.g., clays that have been heated to drive out volatile materials), partially calcined clays (e.g., clays that have been heated to partially drive out volatile materials), composite polymers (e.g., thermoset nanocomposites), halloysite clay nanotubes, and any combination thereof. In certain embodiments, microproppant particles may become anchored and/or adhered to fracture faces within the microfracture, which may produce solid masses in the forms of high strength ridges, bumps, patches, or an uneven film on the fracture face. This may, among other benefits, further assist in maintaining the conductivity of the microfractures.

The microproppant particles may be of any shape (regular or irregular) suitable or desired for a particular application. In one or more embodiments, the microproppant particles may be round or spherical in shape, although they may also take on other shapes such as ovals, capsules, rods, toroids, cylinders, cubes, or variations thereof. In certain embodiments, the microproppant particles of the present disclosure may be relatively flexible or deformable, which may allow them to enter certain perforations, microfractures, or other spaces within the subterranean formation 110 whereas solid particulates of a similar diameter or size may be unable to do so.

In certain embodiments, the plurality of microproppant particles may have a mean particle diameter of about 100 microns or less. In certain embodiments, the plurality of microproppant particles may have a mean particle diameter in a range of from about 0.1 microns to about 100 microns. In one or more embodiments, the plurality of microproppant particles may have a mean particle diameter in a range of from about 0.1 microns to about 50 microns. In one or more embodiments, the plurality of microproppant particles may have a mean particle diameter of about 25 microns or less, in other embodiments, a mean particle diameter of about 10 microns or less, and in other embodiments, a mean particle diameter of about 5 microns or less.

As used herein, the term "diameter" refers to a straight-line segment joining two points on the outer surface of the microproppant particle and passing through the central region of the microproppant particle, but does not imply or require that the microproppant particle is spherical in shape or that it have only one diameter. As used herein, the term "mean particle diameter" refers to the sum of the diameter of each microproppant particle in the plurality of microproppant particles divided by the total number of the microproppant particles in the plurality of microproppant particles. The mean particle diameter of the plurality of microproppant particles may be determined using any particle size analyzer known in the art. In certain embodiments, the mean particle diameter of the plurality of microproppant particles may be determined using a representative subset or sample of microproppant particles from the plurality of microproppant particles. A person of skill in the art with the benefit of the present disclosure will understand how to select such a representative subset or sample of microproppant particles from the plurality of microproppant particles.

In certain embodiments, each of the microproppant particles may have particle sizes smaller than 100 mesh (149 microns), and in certain embodiments may have particle sizes equal to or smaller than 200 mesh (74 microns), 230 mesh (63 microns) or even 325 mesh (44 microns). The size and/or diameter of the microproppant particles may be tailored for a particular application based on, for example, the estimated width of one or more microfractures within the subterranean formation 110 in which the microproppant particles are to be used, as well as other factors. In certain embodiments, the microproppant particles may have a mean particle size distribution less than 100 microns.

In certain embodiments, the microproppant particles may be present in the treatment fluids of the present disclosure in an amount up to about 10 pounds of microproppant particles per gallon of treatment fluid ("ppg"). In certain embodiments, the microproppant particles may be present in the treatment fluids of the present disclosure in an amount within a range of from about 0.01 ppg to about 10 ppg. In one or more embodiments, the microproppant particles may be present in the treatment fluids of the present disclosure in an amount within a range of from about 0.01 ppg to about 0.1 ppg, in other embodiments, from about 0.1 ppg to about 1 ppg, in other embodiments, from about 1 ppg to about 2 ppg, in other embodiments, from about 2 ppg to about 3 ppg, in other embodiments, from about 3 ppg to about 4 ppg, in other embodiments, from about 4 ppg to about 5 ppg, in other embodiments, from about 5 ppg to about 6 ppg, in other embodiments, from about 6 ppg to about 7 ppg, in other embodiments, from about 7 ppg to about 8 ppg, in other embodiments, from about 8 ppg to about 9 ppg, and in other embodiments, from about 9 ppg to about 10 ppg. In certain embodiments, the microproppant particles may be present in the treatment fluids of the present disclosure in an amount within a range of from about 0.01 ppg to about 0.5 ppg. In one or more embodiments, the microproppant particles may be present in the treatment fluids of the present disclosure in an amount within a range of from about 0.01 ppg to about 0.05 ppg, in other embodiments, from about 0.05 ppg to about 0.1 ppg, in other embodiments, from about 0.1 ppg to about 0.2 ppg, in other embodiments, from about 0.2 ppg to about 0.3 ppg, in other embodiments, from about 0.3 ppg to about 0.4 ppg, and in other embodiments, from about 0.4 ppg to about 0.5 ppg. The concentration of the microproppant particles in the treatment fluid may vary depending on the particular application of the treatment fluid (for example, pre-pad fluid, pad fluid, or spacer fluid). In one or more embodiments, the treatment fluid (e.g., pre-pad fluid) may not contain any microproppant particles.

Diverting agents may be used in the methods and systems of the present disclosure and may comprise any particulate material capable of altering some or all of the flow of a substance away from a particular portion of the subterranean formation 110 to another portion of the subterranean formation 110 or, at least in part, ensure substantially uniform injection of a treatment fluid over the region of the subterranean formation to be treated. Diverting agents may, for example, selectively enter more permeable zones of the subterranean formation 110, where they may create a relatively impermeable barrier across the more permeable zones of the formation (including by bridging one or more fractures), thus serving to divert a subsequently introduced treatment fluid into the less permeable portions of the subterranean formation 110. In certain embodiments, the proppants and/or microproppants used in the methods and systems of the present disclosure may serve a dual purpose as both to prevent fractures from fully closing upon the release of the hydraulic pressure thereby forming conductive channels through which fluids may flow to a well bore and as a diverting agent. Such dual-purpose particulates may be referred to herein as "self-diverting" proppants and/or microproppants (while the proppants and/or microproppants may be self-diverting, the term "self-diverting proppants" will be used hereafter to be inclusive of both proppants and microproppants).

In certain embodiments, diverting effects of the self-diverting proppants may be temporary. For example, a degradable and/or soluble self-diverting proppant may be used such that it degrades or dissolves, for example, after a period of time in the subterranean formation 110 or when contacted by a particular fluid or fluids. Examples of degradable self-diverting proppants that may be suitable for use in certain embodiments of the present disclosure include, but are not limited to, fatty alcohols, fatty acid salts, fatty esters, proteinous materials, degradable polymers, and the like. Suitable examples of degradable polymers that may be used in accordance with the present disclosure include, but are not limited to, homopolymers, random, block, graft, and star- and hyper-branched polymers. Specific examples of suitable polymers include polysaccharides such as dextran or cellulose; chitin; chitosan; proteins; aliphatic polyesters; poly(lactide); poly(glycolide); poly(ε-caprolactone); poly(hydroxybutyrate); poly(anhydrides); aliphatic polycarbonates; poly(acrylamide); poly(ortho esters); poly(amino acids); poly(ethylene oxide); and polyphosphazenes. Polyanhydrides are another type of degradable polymers that may be suitable for use as degradable diverting agents in the present disclosure. Examples of polyanhydrides that may be suitable include poly(adipic anhydride), poly(suberic anhydride), poly(sebacic anhydride), and poly(dodecanedioic anhydride). Other suitable examples include but are not limited to poly(maleic anhydride) and poly(benzoic anhydride).

Self-diverting proppants may be introduced into the subterranean formation 110 in a treatment fluid and may be included in treatment fluids in any suitable concentration. In certain embodiments, the self-diverting proppants may be provided at a well site in a slurry that is mixed into the base fluid of the treatment fluid as the fluid is pumped into the first wellbore 120 and/or second wellbore 125. In certain embodiments, the concentration of the self-diverting proppants in the treatment fluid may range from about 0.01 lbs per gallon to about 1 lbs per gallon. In certain embodiments, the concentration of the self-diverting proppants in the treatment fluid may range from about 0.1 lbs per gallon to about 0.3 lbs per gallon. In certain embodiments, the total amount of the self-diverting proppants used for a particular stage of a fracturing operation may range from about 1000 lbs to about 5000 lbs. A person of skill in the art with the benefit of this disclosure will recognize the appropriate amount of the self-diverting proppants to use in an application of the present disclosure based on, among other things, the type of formation, the particle size of the diverting agent, the parameters of the fracturing operation, the desired fracture geometries, and the like.

In certain embodiments, the treatment fluids used in the methods and systems of the present disclosure optionally may comprise any number of additional additives, among other reasons, to enhance and/or impart additional properties of the composition. For example, the compositions of the present disclosure optionally may comprise one or more salts, among other reasons, to act as a clay stabilizer and/or enhance the density of the composition, which may facilitate its incorporation into a treatment fluid. In certain embodiments, the compositions of the present disclosure optionally may comprise one or more dispersants, among other reasons, to prevent flocculation and/or agglomeration of the solids while suspended in a slurry. Other examples of such additional additives include, but are not limited to, salts, surfactants, acids, acid precursors, chelating agents, fluid loss control additives, gas, nitrogen, carbon dioxide, surface modifying agents, tackifying agents, foamers, corrosion inhibitors, scale inhibitors, catalysts, clay control agents, biocides, friction reducers, antifoam agents, bridging agents, flocculants, H2S scavengers, CO2 scavengers, oxygen scavengers, lubricants, viscosifiers, breakers, weighting agents, relative permeability modifiers, resins, wetting agents, coating enhancement agents, filter cake removal agents, antifreeze agents (e.g., ethylene glycol), and the like. A person skilled in the art, with the benefit of this disclosure, will recognize the types of additives that may be included in the fluids of the present disclosure for a particular application.

The methods and systems of the present disclosure may be used during or in conjunction with any subterranean fracturing operation. For example, a treatment fluid may be introduced into the subterranean formation 110 at or above a pressure sufficient to create or enhance one or more fractures in at least a portion of the subterranean formation 110. Such fractures may be "enhanced" where a pre-existing fracture (e.g., naturally occurring or otherwise previously formed) is enlarged or lengthened by the fracturing treatment. Other suitable subterranean operations in which the methods and/or compositions of the present disclosure may be used include, but are not limited to, fracture acidizing, "frac-pack" treatments, and the like.

With reference back to the fracturing of the first wellbore 120 and/or the second wellbore 125 to produce one or more primary fractures 155, the treatment fluid introduced into the first wellbore 120 and/or the second wellbore 125 to produce the one or more primary fractures 155 may comprise a plurality of electro-conductive proppants and electrically controlled propellant ("ECP"). The ECP of the present disclosure may comprise any substance known in the art that can be ignited by passing an electrical current through the propellant. The ECP may be provided as a liquid, or as a solid or semi-solid (e.g., powders, pellets, etc.) dissolved, dispersed, or suspended in a carrier liquid (for example, the treatment fluid). In one or more embodiments, a liquid form of ECP may be particularly suited to penetrating smaller cracks, microfractures, and/or bedding planes in a formation, among other reasons, to more effectively place the ECP in those areas.

In one or more embodiments, the ECP may comprise a liquid propellant, or a mixture of a liquid propellant and a solid propellant, stored in a combustible container, bag, or hose, while it is being placed in the first wellbore 120 and/or second wellbore 125. In one or more embodiments, the combustible container, bag, or hose could be made of metal. In one or more embodiments, a detonation cord could be attached to the combustible container, bag, or hose to allow for efficient ignition of the ECP.

In one or more embodiments, ECP provided in solid form may be used in lieu of or in combination with other proppant materials to prop open small cracks, fractures, or bedding planes in the subterranean formation 110 (e.g., in the far wellbore region of the formation) when the fracturing fluid pressure is released. In one or more embodiments, the ECP may be provided in a composition that comprises a mixture of one or more ECPs and other materials, including but not limited to inert materials such as sand, cement, fly ash, fiberglass, ceramic materials, carbon fibers, polymeric materials, clay, acid soluble materials, degradable materials (e.g., polylactic acid), and the like. In certain embodiments, the ECP may comprise a binder (e.g., polyvinyl alcohol, polyvinylamine nitrate, polyethanolaminobutyne nitrate, polyethyleneimine nitrate, copolymers thereof, and mixtures thereof), an oxidizer (e.g., ammonium nitrate, hydroxylamine nitrate, and mixtures thereof), and a crosslinking agent (e.g., boric acid). Such propellant compositions may further comprise additional optional additives, including but not limited to stability enhancing or combustion modifying agents (e.g., 5-aminotetrazole or a metal complex thereof), dipyridyl complexing agents, polyethylene glycol polymers, and the like. In certain embodiments, the ECP may comprise a polyalkylammonium binder, an oxidizer, and a eutectic material that maintains the oxidizer in a liquid form at the process temperature (e.g., energetic materials such as ethanolamine nitrate (ETAN), ethylene diamine dinitrate (EDDN), or other alkylamines or alkoxylamine nitrates, or mixtures thereof). Such propellants may further comprise a mobile phase comprising at least one ionic liquid (e.g., an organic liquid such as N,n-butylpyridinium nitrate).

As noted above, an electrical current may be applied to the ECP to ignite it in the methods of the present disclosure where such propellants are used. That electrical current may be transmitted or otherwise provided to the ECP in the subterranean formation 110 using any means known in the art. In one or more embodiments, electrical current is provided from a direct current (DC) source, although electrical power from alternating current (AC) sources can be used as well. In one or more embodiments, the source of electrical current may be provided at the surface 115, and the current may be transferred via a conductive wire, cable, and/or tubing into the subterranean formation 110 to the ECP and/or another electrically conductive material in contact with the propellant.

For example, an electrical current may be applied to the first wellbore 120 and/or the second wellbore 125, wherein the electrical current may then be transferred to the plurality of electro-conductive proppants introduced by the treatment fluid. The electro-conductive proppants may be operable to apply the current to nearby, surrounding ECP for ignition. In these embodiments, the electrical current may pass through any number of secondary relays, switches, conduits (e.g., wires or cables), electrodes, equipment made of conductive material (e.g., metal casings, liners, etc.) or other electrically conductive structures. In other embodiments, the electrical current also may be provided by some other downhole energy source (such as downhole charges, hydraulic power generators, batteries, or the like), and then applied to the ECP in the subterranean formation 110 via the plurality of electro-conductive proppants. In certain embodiments, the amount of electrical current applied to ignite the ECP may range from about 1 milliamp to about 100 milliamps. In certain embodiments, the electrical current applied to ignite the ECP may have a corresponding voltage of from about 10 V to about 600 V.

Moreover, in one or more embodiments, certain brine-based fluids may exhibit certain electrical conductivity properties, which may facilitate ignition of the ECP once placed in the first and/or second wellbores 120, 125 within the subterranean formation 110. Examples of non-aqueous fluids (liquids or gases) that may be suitable for use in the methods and systems of the present disclosure include, but are not limited to, oils, hydrocarbons (e.g., liquefied natural gas (LNG), methane, etc.), organic liquids, carbon dioxide, nitrogen, and the like. In certain embodiments, the fracturing fluids, and other treatment fluids described herein, may comprise a mixture of one or more fluids and/or gases, including but not limited to emulsions, foams, and the like.

The ECP may be ignited at any time, and the application of electrical current to the propellant may be triggered in any known way. In one or more embodiments, the current may be applied in response to manual input by an operator, either at the surface 115 of the well site or from a remote location. In other embodiments, the current may be applied automatically in response to the detection of certain conditions in the formation using one or more downhole sensors. Examples of downhole sensors that may be used in this way include, but are not limited to, pressure sensors, temperature sensors, water sensors, motion sensors, chemical sensors, and the like.

In one or more embodiments, the electrical current may be applied to the ECP substantially continuously until substantially all of the propellant has been ignited or the desired fracture geometries have been created in the subterranean formation 110. In other embodiments, the electrical current may be applied to the ECP intermittently. The intermittent ignition of the propellant may generate a series of shorter pulses of energy and/or pressure in the area of the subterranean formation 110 proximate to the first and/or second wellbores 120, 125. The cracks and fractures in the subterranean formation 110 may be permitted to relax or constrict between these intermittent pulses, which may facilitate the creation of more complex fracture geometries and/or more conductive fractures.

In one or more embodiments, the electrical current may be applied intermittently at a frequency that is equal to or approximates a resonant frequency of the region in the subterranean formation 110 near the first and/or second wellbores 120, 125 in order to throttle the burning rate of the ECP. Applying the electrical current at a frequency equal to or approximates the resonant frequency of the region in the subterranean formation 110 near the first and/or second wellbores 120, 125 may help to maximize the fracturing efficiency of the ECP. In other embodiments, the intermittent detonation of the ECP may be timed between two or more lateral boreholes in order to achieve a pulsing effect. The pulsing effect may be equal to or approximate the resonant frequency of the region in the subterranean formation 110 near the first and/or second wellbores 120, 125 and help to maximize the fracturing efficiency of the ECP.

In one or more embodiments, ignition of the ECP, via current applied by the plurality of electro-conductive proppants, may at least partially rupture a portion of the subterranean formation 110 and may cause rubblization of the subterranean formation 110 adjacent to the first wellbore 120 and/or second wellbore 125, breaking of the fabric structure of the matrix of the subterranean formation 110, weakening of the bedding planes to cause tensile and shear failures, and any combination thereof. In one or more embodiments, ignition of the ECP may cause multi-mode failure of the subterranean formation 110, wherein multi-mode failure may comprise of tensile failure, shear failure, tearing, shear induced tensile failure, and any combination thereof. In embodiments, the ignition of the ECP may generate the complex fracture network 105, wherein the complex fracture network may comprise of numerous secondary and tertiary fractures, cracks, and micro-fractures throughout the subterranean formation 110 adjacent to the first and second wellbores 120, 125. By creating the complex fracture network 105, ignition of the ECP may increase the available surface area for heat transfer between a fluid injected through the first wellbore 120 from the surface 115 and produced through the second wellbore 125.

With reference to FIGS. 1A-1B, after the complex fracture network 105 has been created by ignition of the ECP via current applied through the plurality of electro-conductive proppants, an injection fluid may be introduced into the subterranean formation 110 through the first wellbore 120. In one or more embodiments, the injection fluid may comprise fresh water, silicate-saturated water, carbon dioxide, an aqueous electrolyte solution containing magnesium sulfate, and any combinations thereof. The injection fluid may be introduced at a first temperature and may flow through the one or more primary fractures 155, through the complex fracture network 105, and into the second wellbore 125. As the injection fluid flows into the second wellbore 125 to be produced back to the surface 115, the injection fluid may absorb heat from the subterranean formation 110. Heat transfer may occur between the injection fluid and the subterranean formation 110 through the available surface area of the subterranean formation 110. In one or more embodiments, as the surface area available to be contacted by the injection fluid as the injection fluid flows to the second wellbore 125 increases, the amount of heat available to be transferred to the injection fluid may increase. The injection fluid may flow into the second wellbore 125 as a "heat-treated fluid" at a second temperature, wherein the second temperature is greater than the first temperature. In one or more embodiments, the heat-treated fluid may be a gas, substantially in a gaseous state, or a supercritical fluid. The heat-treated fluid may flow through the second wellbore 125 back to the surface 115, wherein the energy recovery system 100 may utilize the heat-treated fluid to actuate the one or more turbines 135 in order to produce electrical power. In embodiments, heat may be transferred away from the heat-treated fluid, thereby reducing the temperature of the heat-treated fluid. The heat-treated fluid may be directed back to the first wellbore 120, wherein the temperature of the heat-treated fluid may be reduced back to the first temperature injection fluid. The utilized or cooled down, heat-treated fluid may be re-introduced through the first wellbore 120 as the injection fluid and repeat the cycle.

Figure 2:
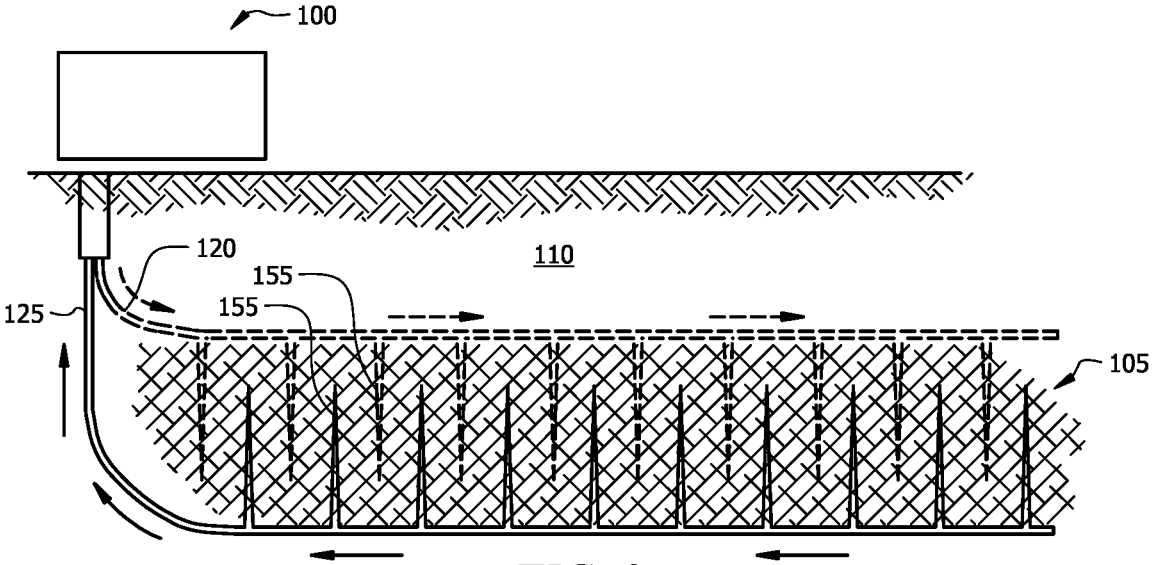
FIG. 2 a diagram illustrating an example of a fracture network, according to aspects of the present disclosure.

FIGS. 2-4D illustrate further embodiments of the fracture network 105 to be produced and utilized with the energy recovery system 100. FIG. 2 illustrates an embodiment of the fracture network 105 wherein the first wellbore 120 and the second wellbore 125 may originate from the same wellbore. As illustrated, the first wellbore 120 may be drilled through the subterranean formation 110 above the second wellbore 125 and may operate injection treatments, whereas the second wellbore 125 may be drilled below the first wellbore 120 and may be operable to perform production operations in conjunction with the first wellbore 120. In one or more embodiments, as the first wellbore 120 deviates from the second wellbore 125, each may be isolated and/or insulated from the other. In one or more embodiments, hydraulic fracturing may occur in the first wellbore 120 and in the second wellbore 125 at substantially the same time or sequentially at different times to produce the one or more primary fractures 155. For example, the first wellbore 120 may be fractured before the second wellbore 125. An electrical current may be applied to the first wellbore to ignite the ECP as the second wellbore 125 undergoing hydraulic fracturing. In this example, the synergy effect of performing both hydraulic fracturing and combustion of the ECP may enhance shear-induced tensile failures of the surrounding subterranean formation 110 and create the complex fracture network 105. Similar to previous embodiments, once the complex fracture network 105 is produced, an injection fluid may be introduced into the subterranean formation 110 through the first wellbore 120. As the injection fluid flows through the one or more primary fractures 155, through the complex fracture network 105, and into the second wellbore 125, the injection fluid may absorb heat from the subterranean formation 110. Heat transfer may occur between the injection fluid and the subterranean formation 110 through the available surface area of the subterranean formation 110. As disclosed by the present embodiment, the synergy between the hydraulic fracturing and the combustion of the ECP may have increased the available surface area of the subterranean formation 110 within the complex fracture network 105. The injection fluid may flow into the second wellbore 125 as a "heat-treated fluid" and may flow through the second wellbore 125 to the energy recovery system 100, wherein the energy recovery system 100 may utilize the heat-treated fluid to produce electrical power. In one or more embodiments, the utilized, cooled down, heat-treated fluid may then be re-introduced through the first wellbore 120 as the injection fluid and repeat the cycle.

Figure 3:
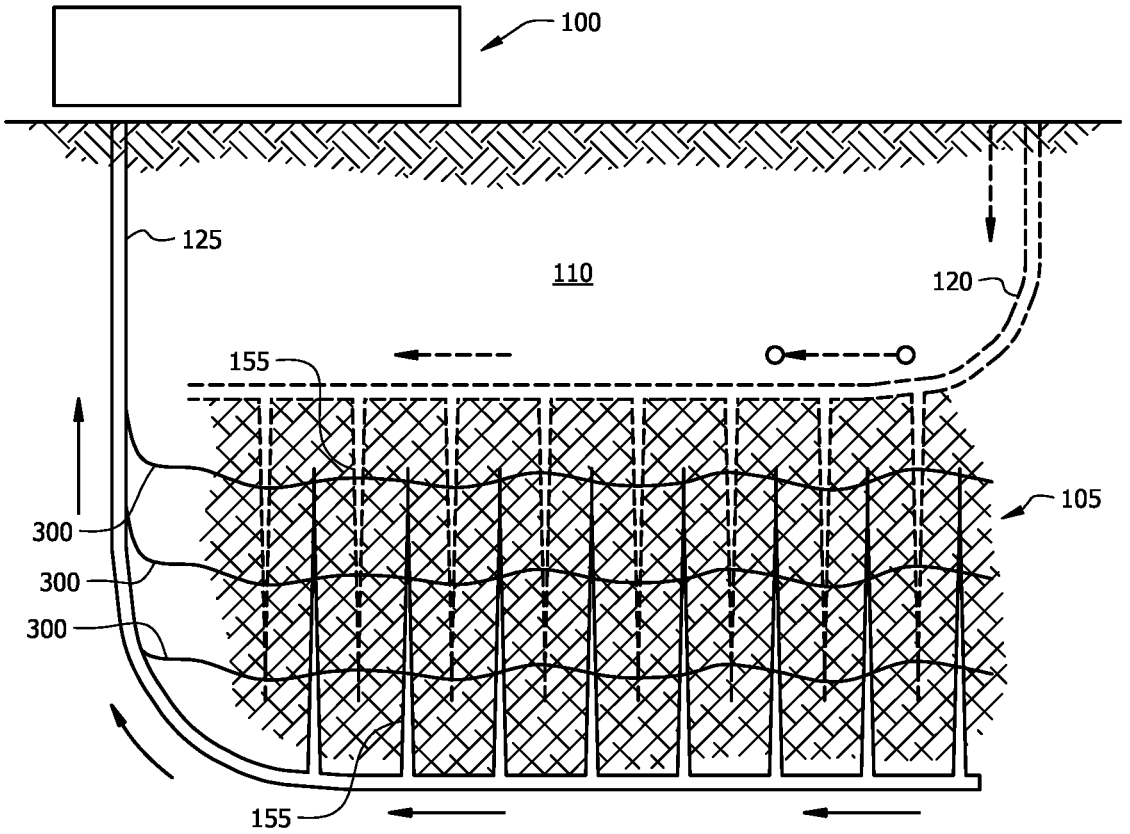
FIG. 3 is a diagram illustrating an example of a fracture network, according to aspects of the present disclosure.

FIG. 3 illustrates an embodiment of the fracture network 105 wherein the second wellbore 125 comprises one or more sacrificial boreholes 300. As illustrated, the one or more sacrificial boreholes 300 may be disposed through the subterranean formation 110 lateral to the second wellbore 125 and between horizontal portions of the first wellbore 120 and the second wellbore 125. In one or more embodiments, a treatment fluid comprising the ECP and the plurality of electro-conductive proppants may be introduced into each of the one or more sacrificial boreholes 300 prior to a hydraulic fracturing operation for either the first wellbore 120 or the second wellbore 125. An electrical current may be applied to the second wellbore 125, which may be applied to the plurality of electro-conductive proppants present within each of the one or more sacrificial boreholes 300, wherein the ECP also present within each of the one or more sacrificial boreholes 300 may be ignited to rubblize the subterranean formation 110 between the first wellbore 120 and the second wellbore 125. In one or more embodiments, after ignition of the ECP in the one or more sacrificial boreholes 300, the first wellbore 120 and/or the second wellbore 125 may undergo hydraulic fracturing to create the one or more primary fractures 155 and the complex fracture network 105. Similar to previous embodiments, once the complex fracture network 105 is produced, an injection fluid may be introduced into the subterranean formation 110 through the first wellbore 120. As the injection fluid flows through the one or more primary fractures 155, through the complex fracture network 105, and into the second wellbore 125, the injection fluid may absorb heat from the subterranean formation 110. Heat transfer may occur between the injection fluid and the subterranean formation 110 through the available surface area of the subterranean formation 110. The injection fluid may then flow into the second wellbore 125 as a "heat-treated fluid" and may flow through the second wellbore 125 to the energy recovery system 100, wherein the energy recovery system 100 may utilize the heat-treated fluid to produce electrical power. In one or more embodiments, the utilized, cooled down, heat-treated fluid may then be re-introduced through the first wellbore 120 as the injection fluid and repeat the cycle.

Figure 4A:
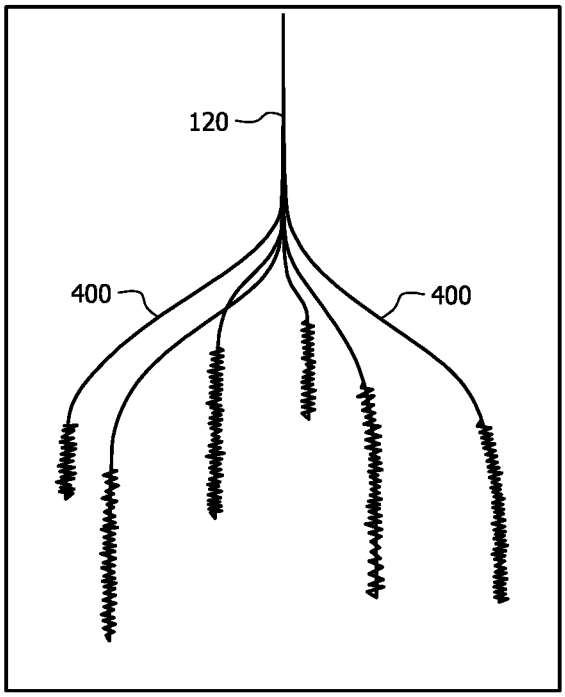
FIGS. 4A, 4B, 4C, and 4D are diagrams illustrating an example of a fracture network, according to aspects of the present disclosure.
Figure 4B:
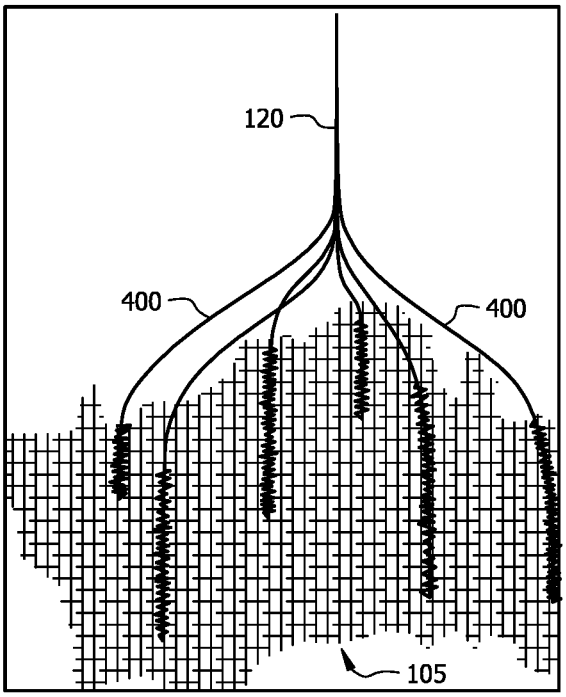

FIGS. 4A-4D illustrate an embodiment of the fracture network 105 wherein the first wellbore 120 comprises one or more vertical boreholes 400. As illustrated in FIG. 4A, the one or more vertical boreholes 400 may originate from the first wellbore 120 and may extend further below the first wellbore 120. In one or more embodiments, a treatment fluid comprising the ECP and the plurality of electro-conductive proppants may be introduced into each of the one or more vertical boreholes 400 through the first wellbore 120. As illustrated in FIG. 4B, an electrical current may be applied to the first wellbore 120, which may be applied to the plurality of electro-conductive proppants present within each of the one or more vertical boreholes 400, wherein the ECP also present within each of the one or more vertical boreholes 400 may be ignited.

Figure 4C:
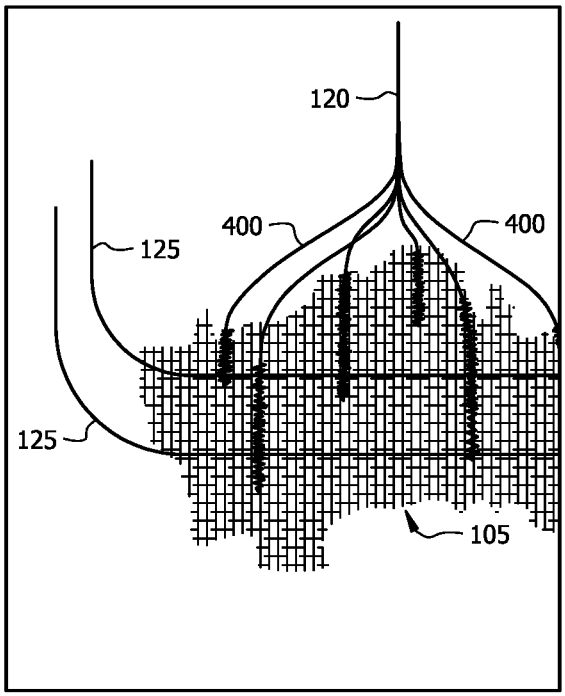
Figure 4D:
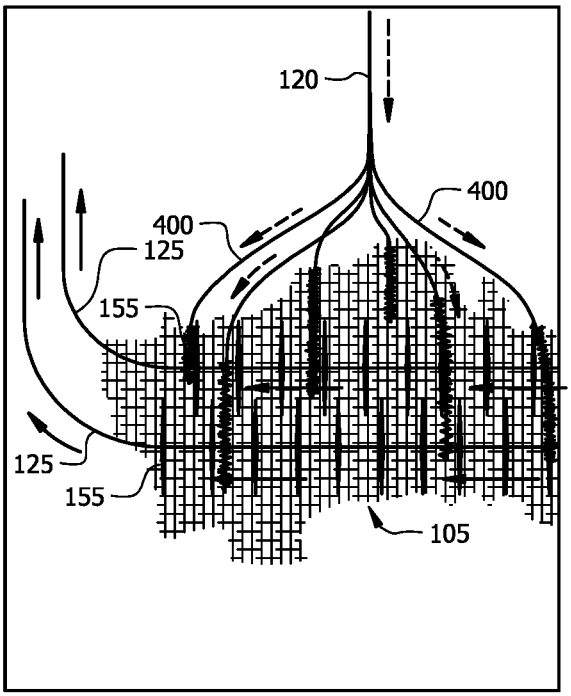

In one or more embodiments, after ignition of the ECP in the one or more vertical boreholes 400, one or more second wellbores 125 may be drilled, wherein at least a lateral portion of each of the one or more second wellbores 125 may be disposed near the one or more vertical boreholes 400. As illustrated in FIG. 4C, the lateral portion of the one or more second wellbores 125 may be disposed through the area rubblized by the ignition and combustion of the ECP in the one or more vertical boreholes 400. As illustrated in FIG. 4D, each of the one or more second wellbores 125 may undergo hydraulic fracturing to create the one or more primary fractures 155 and the complex fracture network 105.

Similar to previous embodiments, once the complex fracture network 105 is produced, an injection fluid may be introduced into the subterranean formation 110 through the first wellbore 120 and through the one or more vertical boreholes 400. As the injection fluid flows through the complex fracture network 105, the one or more primary fractures 155, and into the one or more second wellbores 125, the injection fluid may absorb heat from the subterranean formation 110 (referring to FIGS. 1A-3). Heat transfer may occur between the injection fluid and the subterranean formation 110 through the available surface area of the subterranean formation 110. The injection fluid may then flow into the one or more second wellbores 125 as a "heat-treated fluid" and may flow through the one or more second wellbores 125 to the energy recovery system 100 (referring to FIGS. 1A-3), wherein the energy recovery system 100 may utilize the heat-treated fluid to produce electrical power. In one or more embodiments, the utilized, cooled down, heat-treated fluid may then be re-introduced through the first wellbore 120 as the injection fluid and repeat the cycle.

The treatment fluids used in the methods and systems of the present disclosure may be prepared using any suitable method and/or equipment (e.g., blenders, stirrers, etc.) known in the art at any time prior to their use. In one or more embodiments, the treatment fluids may be prepared at a well site or at an offsite location. In certain embodiments, an aqueous fluid may be mixed the gelling agent first, among other reasons, in order to allow the gelling agent to hydrate and form a gel. Once the gel is formed, proppants and/or diverting agents may be mixed into the gelled fluid. Once prepared, a treatment fluid of the present disclosure may be placed in a tank, bin, or other container for storage and/or transport to the site where it is to be used. In other embodiments, a treatment fluid of the present disclosure may be prepared on-site, for example, using continuous mixing or "on-the-fly" methods, as described below.

In certain embodiments of the methods and systems of the present disclosure, one or more additional fluids may be introduced into the well bore before, after, and/or concurrently with the treatment fluid, for any number of purposes or treatments in the course of a fracturing operation. Examples of such fluids include, but are not limited to, preflush fluids, pad fluids, pre-pad fluids, acids, afterflush fluids, cleaning fluids, and the like. For example, a pad fluid may be pumped into the well bore prior to the sequential stages of proppant-carrying treatment fluid and clean treatment fluid. In certain embodiments, another volume of pad fluid may be pumped into the well bore between each one of the sequential stages. The "clean" treatment fluid generally comprises a lesser concentration of proppant than the proppant-carrying treatment fluid. In certain embodiments, a "clean" treatment fluid may be a fluid that is substantially free of proppant and/or does not comprise a significant concentration of proppant, although in other embodiments a "clean" treatment fluid may comprise some significant concentration of proppant. A person of skill in the art with the benefit of this disclosure will recognize the appropriate types of additional fluids to use, and when they may be used, in the methods and systems of the present disclosure.

Figure 5:
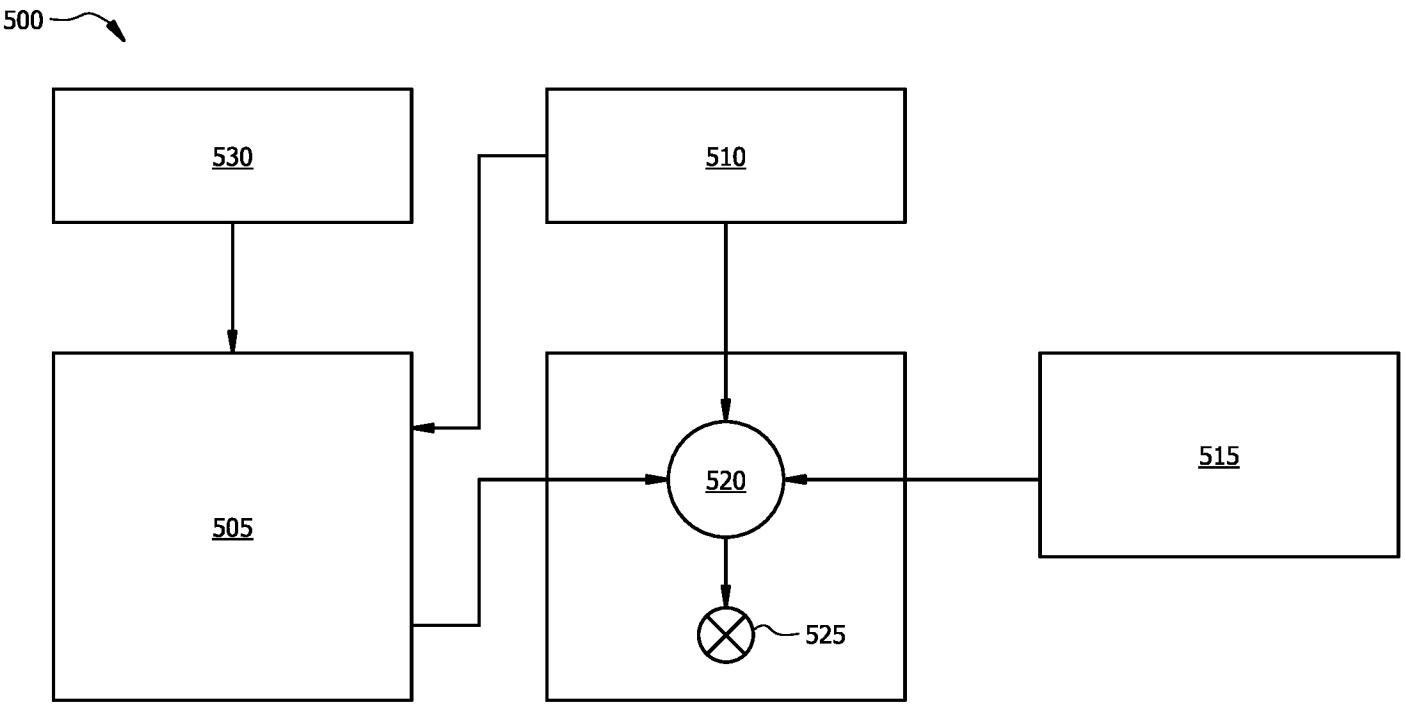
FIG. 5 is a diagram illustrating an example fracturing system, according to aspects of the present disclosure.

Certain embodiments of the methods and compositions disclosed herein may directly or indirectly affect one or more components or pieces of equipment associated with the preparation, delivery, recapture, recycling, reuse, and/or disposal of the disclosed compositions. For example, and with reference to FIG. 5, the disclosed methods and compositions may directly or indirectly affect one or more components or pieces of equipment associated with an exemplary fracturing system 500, according to one or more embodiments. In certain instances, the system 500 includes a fracturing fluid producing apparatus 505, a fluid source 510, a proppant source 515, and a pump and blender system 520 and resides at the surface at a well site where a well 525 is located. In certain instances, the fracturing fluid producing apparatus 505 combines a gel pre-cursor with fluid (e.g., liquid or substantially liquid) from fluid source 510, to produce a hydrated fracturing fluid that is used to fracture the formation. The hydrated fracturing fluid can be a fluid for ready use in a fracture stimulation treatment of the well 525 or a concentrate to which additional fluid is added prior to use in a fracture stimulation of the well 525. In other instances, the fracturing fluid producing apparatus 505 can be omitted and the fracturing fluid sourced directly from the fluid source 510. In certain instances, the fracturing fluid may comprise water, a hydrocarbon fluid, a polymer gel, foam, air, wet gases and/or other fluids.

The proppant source 515 can include a proppant for combination with the fracturing fluid. The system may also include additive source 530 that provides one or more additives (e.g., gelling agents, breaking agents, and/or other optional additives) to alter the properties of the fracturing fluid. For example, the other additives 70 can be included to reduce pumping friction, to reduce or eliminate the fluid's reaction to the geological formation in which the well is formed, to operate as surfactants, and/or to serve other functions.

The pump and blender system 520 receives the fracturing fluid and combines it with other components, including proppant from the proppant source 515 and/or additional fluid from the additives 70. The resulting mixture may be pumped down the well 525 under a pressure sufficient to create or enhance one or more fractures in a subterranean zone, for example, to stimulate production of fluids from the zone. Notably, in certain instances, the fracturing fluid producing apparatus 505, fluid source 510, and/or proppant source 515 may be equipped with one or more metering devices (not shown) to control the flow of fluids, proppants, and/or other compositions to the pumping and blender system 520. Such metering devices may permit the pumping and blender system 520 can source from one, some or all of the different sources at a given time, and may facilitate the preparation of fracturing fluids in accordance with the present disclosure using continuous mixing or "on-the-fly" methods. Thus, for example, the pumping and blender system 520 can provide just fracturing fluid into the well at times, just proppants at other times, and combinations of those components at yet other times.

Figure 6:
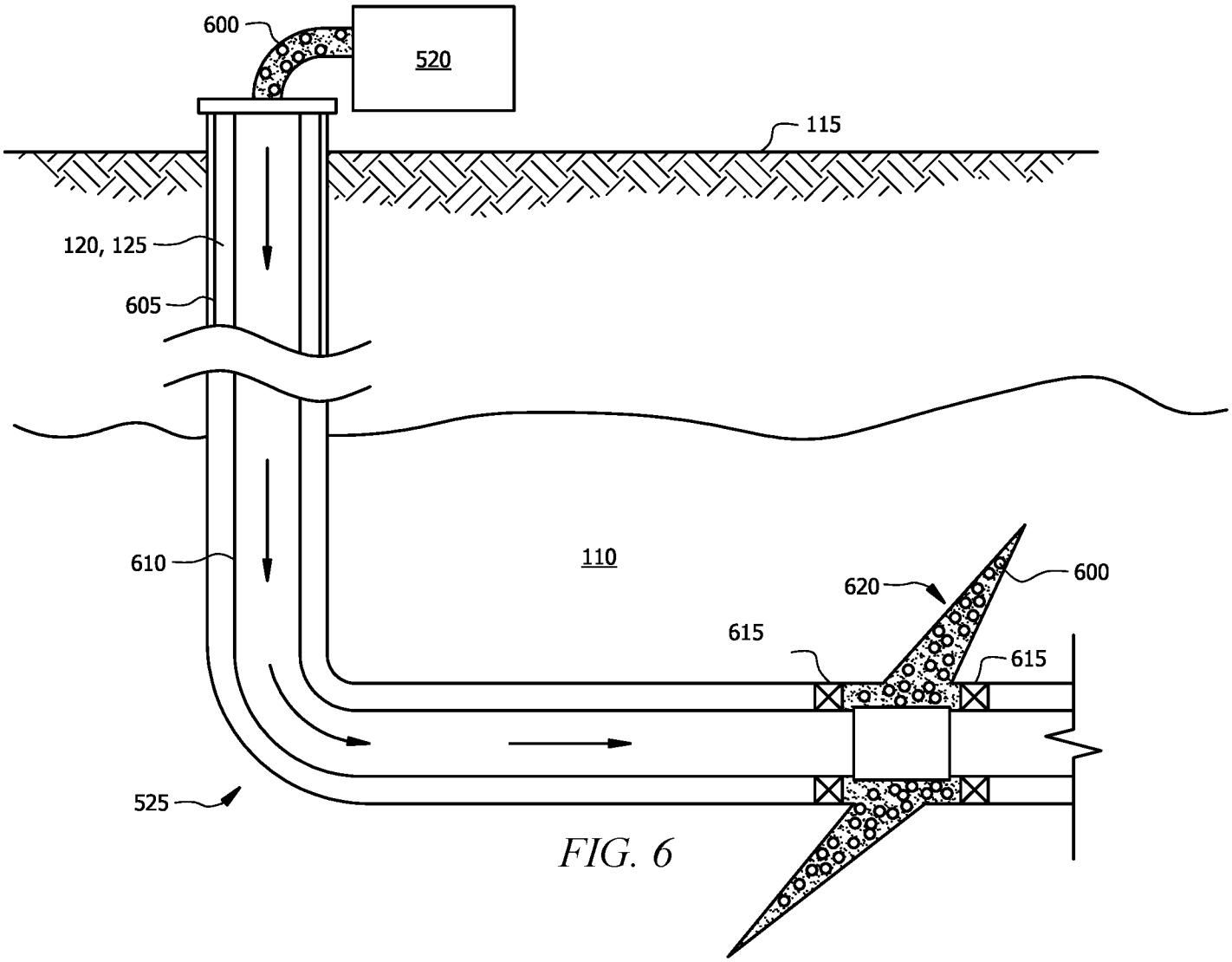
FIG. 6 is a diagram illustrating an example of a subterranean formation in which a fracturing operation may be performed, according to aspects of the present disclosure.

FIG. 6 illustrates the well 525 during a fracturing operation in a portion of a subterranean formation 110 surrounding the first or second wellbore 120, 125. The first or second wellbore 120, 125 extends from the surface 115, and a fracturing fluid 600 is applied to a portion of the subterranean formation 110 surrounding the horizontal portion of the first or second wellbore 120, 125. Although shown as vertical deviating to horizontal, the first or second wellbore 120, 125 may include horizontal, vertical, slant, curved, and other types of well bore geometries and orientations, and the fracturing treatment may be applied to a subterranean zone surrounding any portion of the first or second wellbore 120, 125. The first or second wellbore 120, 125 can include a casing 605 that is cemented or otherwise secured to the well bore wall. first or second wellbore 120, 125 can be uncased or include uncased sections. Perforations can be formed in the casing 605 to allow fracturing fluids and/or other materials to flow into the subterranean formation 110. In cased wells, perforations can be formed using shape charges, a perforating gun, hydro jetting and/or other tools.

The well 525 is shown with a work string 610 depending from the surface 115 into the first or second wellbore 120, 125. The pump and blender system 520 is coupled to the work string 610 to pump the fracturing fluid 600 into the first or second wellbore 120, 125. The work string 610 may include coiled tubing, jointed pipe, and/or other structures that allow fluid to flow into the first or second wellbore 120, 125. The work string 610 can include flow control devices, bypass valves, ports, and or other tools or well devices that control a flow of fluid from the interior of the work string 610 into the subterranean formation 110. For example, the work string 610 may include ports adjacent the well bore wall to communicate the fracturing fluid 600 directly into the subterranean formation 110, and/or the work string 610 may include ports that are spaced apart from the well bore wall to communicate the fracturing fluid 600 into an annulus in the well bore between the work string 610 and the well bore wall.

The work string 610 and/or the first or second wellbore 120, 125 may include one or more sets of packers 615 that seal the annulus between the work string 610 and first or second wellbore 120, 125 to define an interval of the first or second wellbore 120, 125 into which the fracturing fluid 600 will be pumped. FIG. 6 shows two packers 615, one defining an uphole boundary of the interval and one defining the downhole end of the interval. When the fracturing fluid 600 is introduced into first or second wellbore 120, 125 (e.g., in FIG. 6, the area of the first or second wellbore 120, 125 between packers 615) at a sufficient hydraulic pressure, one or more fractures 620 (for example, primary fractures 155 in FIGS. 1A-1B) may be created in the subterranean formation 110. The proppant particulates in the fracturing fluid 600 may enter the fractures 620 where they may remain after the fracturing fluid flows out of the well bore. These proppant particulates may "prop" fractures 620 such that fluids may flow more freely through the fractures 620.

While not specifically illustrated herein, the disclosed methods and compositions may also directly or indirectly affect any transport or delivery equipment used to convey the compositions to the fracturing system 500 such as, for example, any transport vessels, conduits, pipelines, trucks, tubulars, and/or pipes used to fluidically move the compositions from one location to another, any pumps, compressors, or motors used to drive the compositions into motion, any valves or related joints used to regulate the pressure or flow rate of the compositions, and any sensors (i.e., pressure and temperature), gauges, and/or combinations thereof, and the like.

An embodiment of the present disclosure is a method of enhancing heat transfer between an injection fluid and a subterranean formation, comprising: introducing a fracturing fluid into a first wellbore, wherein the fracturing fluid comprises a plurality of electro-conductive proppants and electrically controlled propellant; introducing the fracturing fluid into a second wellbore, wherein the first wellbore and the second wellbore penetrate at least a portion of the subterranean formation, wherein the fracturing fluid is introduced into the first wellbore and the second wellbore at or above a pressure sufficient to create or enhance one or more primary fractures in the subterranean formation; applying an electrical current to the first wellbore, the second wellbore, or both, wherein the plurality of electro-conductive proppants is operable to receive the electrical current; igniting the electrically controlled propellant through application of the electrical current from the plurality of electro-conductive proppants to rubblize the subterranean formation; and introducing an injection fluid into the first wellbore, wherein the injection fluid is configured to flow through the subterranean formation and into the second wellbore, wherein the injection fluid is operable to absorb heat from available surface area from the rubblized to subterranean formation.

In one or more embodiments described in the preceding paragraph, wherein the first wellbore and the second wellbore originate from a single wellbore, wherein the first wellbore deviates from the second wellbore, wherein each of the first wellbore and the second wellbore is isolated and insulated from each other. In one or more embodiments described above, wherein the second wellbore comprises one or more sacrificial boreholes, further comprising introducing a treatment fluid comprising the plurality of electro-conductive proppants and the electrically controlled propellant into each of the one or more sacrificial boreholes through the second wellbore. In one or more embodiments described above, further comprising drilling the one or more sacrificial boreholes from the second wellbore, wherein each of the one or more sacrificial boreholes is fluidically coupled to the second wellbore. In one or more embodiments described above, wherein applying the electrical current to the second wellbore and igniting the electrically controlled propellant occurs before introducing the fracturing fluid into the first wellbore and the second wellbore. In one or more embodiments described above, further comprising drilling the first wellbore and the second wellbore, wherein the first wellbore and the second wellbore are at least partially horizontal wellbores. In one or more embodiments described above, wherein ignition of the electrically controlled propellant causes the formation of a complex fracture network, the complex fracture network comprising one or more secondary or tertiary fractures in the subterranean formation. In one or more embodiments described above, wherein at least one of the one or more primary fractures is at least partially connected to the complex fracture network. In one or more embodiments described above, further comprising introducing a first low viscosity fluid at or above a pressure sufficient to create or enhance at least one fracture in the complex fracture network of the subterranean formation, wherein the first low viscosity fluid comprises a plurality of microproppants. In one or more embodiments described above, further comprising introducing a second low viscosity fluid at or above a pressure sufficient to create or enhance at least one fracture in the complex fracture network of the subterranean formation, wherein the second low viscosity fluid comprises a plurality of proppants. In one or more embodiments described above, wherein the electrical current is applied to the electrically controlled propellant intermittently at a frequency that is equal to or approximates a resonant frequency of a region in the subterranean formation near the first wellbore or the second wellbore. In one or more embodiments described above, wherein the intermittent frequency of ignition of the electrically controlled propellant is timed to occur between the first wellbore and the second wellbore in order to achieve a pulsing effect. In one or more embodiments described above, wherein the plurality of electro-conductive proppants comprises proppant coated with electrically conductive material, wherein the electrically conductive material is selected from a group consisting of aluminum, iron, copper, nickel, cobalt, zinc, any alloy or mixture thereof, pyrolytic carbon, carbon black, graphite, coke breeze, petroleum coke, carbon fiber, carbon nanotubes, and any combination thereof. In one or more embodiments described above, wherein the electrically controlled propellant comprises: a binder selected from a group consisting of polyvinyl alcohol, polyvinylamine nitrate, polyethanolaminobutyne nitrate, polyethyleneimine nitrate, any copolymer thereof, and any mixture thereof, an oxidizer selected from a group consisting of ammonium nitrate, hydroxylamine nitrate, and any mixture thereof; and a crosslinking agent.

Another embodiment of the present disclosure is a method of enhancing heat transfer between an injection fluid and a subterranean formation, comprising: introducing a treatment fluid into a first wellbore comprising one or more vertical boreholes, wherein the treatment fluid comprises a plurality of electro-conductive proppants and electrically controlled propellant; applying an electrical current to the first wellbore, wherein the plurality of electro-conductive proppants is operable to receive the electrical current; igniting the electrically controlled propellant through application of the electrical current from the plurality of electro-conductive proppants to rubblize the subterranean formation; introducing a fracturing fluid into one or more second wellbores, wherein the fracturing fluid is introduced into the one or more second wellbores at or above a pressure sufficient to create or enhance one or more primary fractures in the subterranean formation; and introducing an injection fluid into the first wellbore, wherein the injection fluid is configured to flow through the subterranean formation and into the one or more second wellbores, wherein the injection fluid is operable to absorb heat from available surface area from the rubblized subterranean formation.

In one or more embodiments described in the preceding paragraph, further comprising drilling the one or more second wellbores after ignition of the electrically controlled propellant. In one or more embodiments described above, wherein ignition of the electrically controlled propellant causes the formation of a complex fracture network, the complex fracture network comprising one or more secondary or tertiary fractures in the subterranean formation, wherein at least one of the one or more primary fractures is at least partially connected to the complex fracture network. In one or more embodiments described above, wherein the electrical current is applied to the electrically controlled propellant intermittently at a frequency that is equal to or approximates a resonant frequency of a region in the subterranean formation near the first wellbore or the second wellbore. In one or more embodiments described above, wherein the plurality of electro-conductive proppants comprises proppant coated with electrically conductive material, wherein the electrically conductive material is selected from a group consisting of aluminum, iron, copper, nickel, cobalt, zinc, any alloy or mixture thereof, pyrolytic carbon, carbon black, graphite, coke breeze, petroleum coke, carbon fiber, carbon nanotubes, and any combination thereof. In one or more embodiments described above, wherein the electrically controlled propellant comprises: a binder selected from a group consisting of polyvinyl alcohol, polyvinylamine nitrate, polyethanolaminobutyne nitrate, polyethyleneimine nitrate, any copolymer thereof, and any mixture thereof; an oxidizer selected from a group consisting of ammonium nitrate, hydroxylamine nitrate, and any mixture thereof; and a crosslinking agent.

Unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method of enhancing heat transfer between an injection fluid and a subterranean formation, comprising:

introducing a fracturing fluid into a first wellbore, wherein the fracturing fluid comprises a plurality of electro-conductive proppants and electrically controlled propellant;

introducing the fracturing fluid into a second wellbore, wherein the first wellbore and the second wellbore penetrate at least a portion of the subterranean formation, wherein the fracturing fluid is introduced into the first wellbore and the second wellbore at or above a pressure sufficient to create or enhance one or more primary fractures in the subterranean formation;

applying an electrical current to the first wellbore, the second wellbore, or both, wherein the plurality of electro-conductive proppants receives the electrical current;

igniting the electrically controlled propellant through application of the electrical current from the plurality of electro-conductive proppants to rubblize the subterranean formation such that a complex fracture network is generated, wherein the complex fracture network comprises secondary and tertiary fractures, cracks, and micro-fractures throughout the rubblized subterranean formation; and introducing an injection fluid into the first wellbore, wherein the injection fluid flows through the rubblized subterranean formation and into the second wellbore, wherein the injection fluid absorbs heat from available surface area from the rubblized subterranean formation.

2. The method of claim 1, wherein the first wellbore and the second wellbore originate from a single wellbore, wherein the first wellbore deviates from the second wellbore, wherein each of the first wellbore and the second wellbore is isolated and insulated from each other.

3. The method of claim 2, wherein the first wellbore and the second wellbore are at least partially horizontal wellbores.

4. The method of claim 1, wherein the second wellbore comprises one or more sacrificial boreholes, further comprising introducing a treatment fluid comprising the plurality of electro-conductive proppants and the electrically controlled propellant into each of the one or more sacrificial boreholes through the second wellbore.

5. The method of claim 4, further comprising drilling the one or more sacrificial boreholes from the second wellbore, wherein each of the one or more sacrificial boreholes is fluidically coupled to the second wellbore.

6. The method of claim 4, wherein applying the electrical current to the second wellbore and igniting the electrically controlled propellant occurs before introducing the fracturing fluid into the first wellbore and the second wellbore.

7. The method of claim 1, further comprising drilling the first wellbore and the second wellbore, wherein the first wellbore and the second wellbore are at least partially horizontal wellbores.

8. The method of claim 1, wherein at least one of the one or more|primary fractures is at least partially connected to the complex fracture network.

9. The method of claim 1, further comprising introducing a first viscosity fluid that has a viscosity of 25 cP or lower at or above a pressure sufficient to create or enhance at least one fracture in the complex fracture network of the subterranean formation, wherein the first fluid comprises a plurality of microproppants.

10. The method of claim 9, further comprising introducing a second fluid that has a viscosity of 25 cP or lower at or above a pressure sufficient to create or enhance at least one fracture in the complex fracture network of the subterranean formation, wherein the second low viscosity fluid comprises a plurality of proppants.

11. The method of claim 1, wherein the electrical current is applied to the electrically controlled propellant intermittently at a frequency that is equal to or approximates a resonant frequency of a region in the subterranean formation penetrated by the first wellbore or the second wellbore.

12. The method of claim 11, wherein the intermittent frequency of ignition of the electrically controlled propellant is timed to occur between the first wellbore and the second wellbore in order to achieve a pulsing effect.

13. The method of claim 1, wherein the plurality of electro-conductive proppants comprises proppant coated with electrically conductive material, wherein the electrically conductive material is selected from a group consisting of aluminum, iron, copper, nickel, cobalt, zinc, any alloy or mixture thereof, pyrolytic carbon, carbon black, graphite, coke breeze, petroleum coke, carbon fiber, carbon nanotubes, and any combination thereof.

14. The method of claim 1, wherein the electrically controlled propellant comprises:

a binder selected from a group consisting of polyvinyl alcohol, polyvinylamine nitrate, polyethanolaminobutyne nitrate, polyethyleneimine nitrate, any copolymer thereof, and any mixture thereof;

an oxidizer selected from a group consisting of ammonium nitrate, hydroxylamine nitrate, and any mixture thereof; and a crosslinking agent.

15. The method of claim 1, wherein rubblizing the subterranean formation increases the available surface area for the injection fluid to contact as the injection fluid flows through the complex fracture network.

16. A method of enhancing heat transfer between an injection fluid and a subterranean formation, comprising:

introducing a treatment fluid into a first wellbore comprising one or more vertical boreholes, wherein the treatment fluid comprises a plurality of electro-conductive proppants and electrically controlled propellant;

applying an electrical current to the first wellbore, wherein the plurality of electro-conductive proppants receives the electrical current;

igniting the electrically controlled propellant through application of the electrical current from the plurality of electro-conductive proppants to rubblize the subterranean formation such that a complex fracture network is generated, wherein the complex fracture network comprises secondary and tertiary fractures, cracks, and micro-fractures throughout the rubblized subterranean formation;

introducing a fracturing fluid into one or more second wellbores, wherein the fracturing fluid is introduced into the one or more second wellbores at or above a pressure sufficient to create or enhance one or more primary fractures in the subterranean formation; and introducing an injection fluid into the first wellbore, wherein the injection fluid flows through the rubblized subterranean formation and into the one or more second wellbores, wherein the injection fluid absorbs heat from available surface area from the rubblized subterranean formation.

17. The method of claim 16, further comprising drilling the one or more second wellbores after ignition of the electrically controlled propellant.

18. The method of claim 16, wherein the electrical current is applied to the electrically controlled propellant intermittently at a frequency that is equal to or approximates a resonant frequency of a region in the subterranean formation near the first wellbore or the second wellbore.

19. The method of claim 16, wherein the plurality of electro-conductive proppants comprises proppant coated with electrically conductive material, wherein the electrically conductive material is selected from a group consisting of aluminum, iron, copper, nickel, cobalt, zinc, any alloy or mixture thereof, pyrolytic carbon, carbon black, graphite, coke breeze, petroleum coke, carbon fiber, carbon nanotubes, and any combination thereof.

20. The method of claim 16, wherein the electrically controlled propellant comprises:

a binder selected from a group consisting of polyvinyl alcohol, polyvinylamine nitrate, polyethanolaminobutyne nitrate, polyethyleneimine nitrate, any copolymer thereof, and any mixture thereof;

an oxidizer selected from a group consisting of ammonium nitrate, hydroxylamine nitrate, and any mixture thereof; and a crosslinking agent.

* * * * *